US008356917B2

(12) United States Patent
Ng et al.

(10) Patent No.: US 8,356,917 B2
(45) Date of Patent: Jan. 22, 2013

(54) LIGHT SOURCE

(75) Inventors: Keat Chuan Ng, Gelugor (MY); Chiau Jin Lee, Bayan Lepas (MY); Kheng Leng Tan, Bayan Lepas (MY); Aizar Abdul Karim Norfidathul, Simpang Ampat (MY)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 725 days.

(21) Appl. No.: 12/544,140

(22) Filed: Aug. 19, 2009

(65) Prior Publication Data

US 2011/0044062 A1 Feb. 24, 2011

(51) Int. Cl.
*F21V 21/00* (2006.01)

(52) U.S. Cl. ..... 362/249.02; 362/631; 362/800; 257/99; 257/690; 313/323

(58) Field of Classification Search ..... 362/249.02, 362/382, 631, 800; 257/98, 99, 690, 692, 257/E23.043; 313/323
See application file for complete search history.

(56) References Cited

U.S. PATENT DOCUMENTS

| | | | | |
|---|---|---|---|---|
| 7,365,407 | B2 | 4/2008 | Ng | |
| 7,405,433 | B2 | 7/2008 | Chew | |
| 7,514,724 | B2 * | 4/2009 | Ng et al. | 257/99 |
| 2008/0079019 | A1 | 4/2008 | Huang | |
| 2008/0296590 | A1 | 12/2008 | Ng | |
| 2008/0298081 | A1 | 12/2008 | Oon | |
| 2010/0296297 | A1 * | 11/2010 | Ong et al. | 362/310 |

* cited by examiner

*Primary Examiner* — Stephen F Husar

(57) ABSTRACT

An embodiment of a light source comprises a first lead and a second lead. The first lead comprises a first mounting surface wherein a first light emitter is connectable to the first mounting surface, a support member attached to the first mounting surface, a conductor portion attached to the support member, and at least one tab extending from the first mounting surface, the at least one tab being used to hold the first lead during fabrication. The second lead is second lead located adjacent the first lead and comprises a second mounting surface wherein a second light emitter is connectable to the second mounting surface, at least two support members attached to the second mounting surface, and a conductor portion attached to each of the support members.

20 Claims, 3 Drawing Sheets

LIGHT SOURCE

BACKGROUND

Many light sources use a plurality of light-emitting diodes (LEDs) to generate light. In some embodiments, the light sources use a plurality of different colored LEDs in order to generate a broad spectrum of light. In order to generate a high intensity of light, the light sources use high power LEDs. High power LEDs, however, generate a lot of heat. In small applications, the light sources cannot dissipate heat well, which limits the amount of power that can be input to the LEDs. This in turn limits the intensity of light that can be produced by a light source.

DETAILED DESCRIPTION

Figure 1:
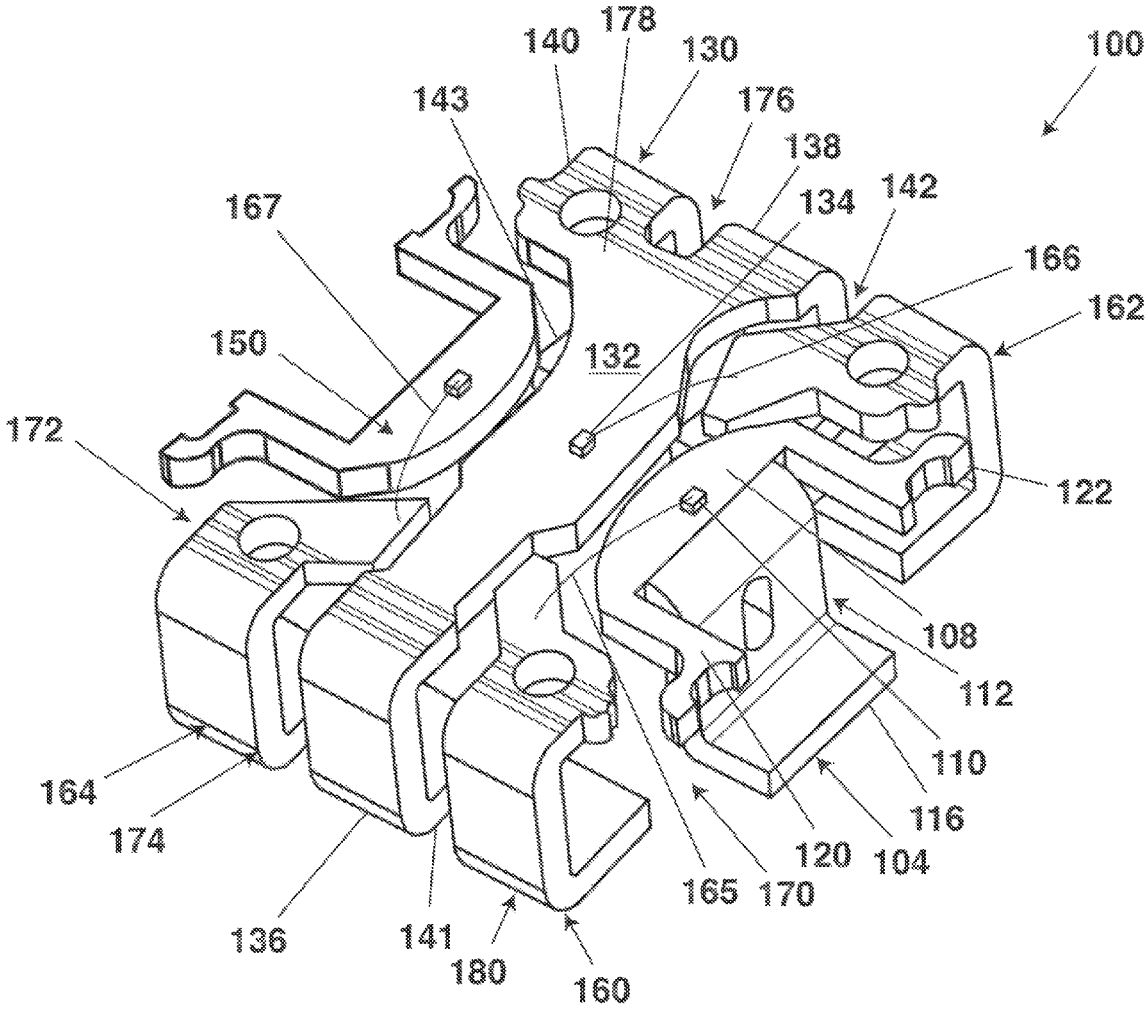
FIG. 1 is a top perspective view of an embodiment of the internal components of a light source.

A top perspective view of an embodiment of the internal components of a light source 100 is shown in FIG. 1. The light source 100 uses its leads to conduct heat from light emitters located therein. In addition, the light source uses tabs on the leads that are used for fabrication as heat sinks to further dissipate heat. Another heat dissipation element of the light source 100 is the mounting of leads around the circumference of the light source, which provides more heat paths for heat dissipation. The embodiment of the light source 100 of FIG. 1 is a surface mount device, meaning that the aforementioned leads attach the light source to a circuit board using surface mount technology.

The light source 100 has a first lead 104. As mentioned above and as described in greater detail below, the first lead 104 may be adapted to mount to a circuit board via surface mount technology. The first lead 104 has a first mounting surface 108 that is adapted to have a first light emitter 110 connected thereto. In some embodiments, the first mounting surface 108 may have a plurality of light emitters connected thereto. In some embodiments, the light emitter 110 is a light-emitting diode (LED) 110. A support member 112 extends from the first mounting surface. In the embodiment of FIG. 1, the support member 112 extends substantially perpendicular to the first mounting surface 108. A mounting portion 116 extends from the support member 112 and serves to connect the light source 100 to a circuit board. In some embodiments, the mounting portion 116 extends substantially perpendicular to the support member 112. The mounting portion 116 also enables heat to transfer from the first lead 104 to the circuit board.

At least one tab extends from the mounting surface 108. In the embodiment described herein, two tabs extend from the mounting surface 108. The tabs are referred to as the first tab 120 and the second tab 122. The tabs 120, 122 are used to hold the first lead 104 during fabrication of the first lead 104. For example, the first lead 104 may be stamped from a sheet of material, such as a metal. The above-described components of the first lead 104 may then be bent to form the first lead 104 shown in FIG. 1. During the stamping and/or bending stages, the tabs 120, 122 are used to secure the first lead 104 in a predetermined location. As described in greater detail below, the tabs 120, 122 serve to dissipate heat from the light emitter 110.

A second lead 130 is located adjacent the first lead 104. Like the first lead 104, the second lead 130 has a mounting surface 132 wherein at least one second light emitter 134 is connectable to the mounting surface 132. The mounting surface 132 is sometimes referred to herein as the second mounting surface 132. A plurality of support members extend from the second mounting surface 132. In the embodiment described herein, three support members extend substantially perpendicular to the second mounting surface 132. The support members are referred to individually as the first support member 136, the second support member 138, and the third support member 140. As described above, the support members 136, 138, and 140 may extend substantially perpendicular to the second mounting surface 132.

Figure 2:
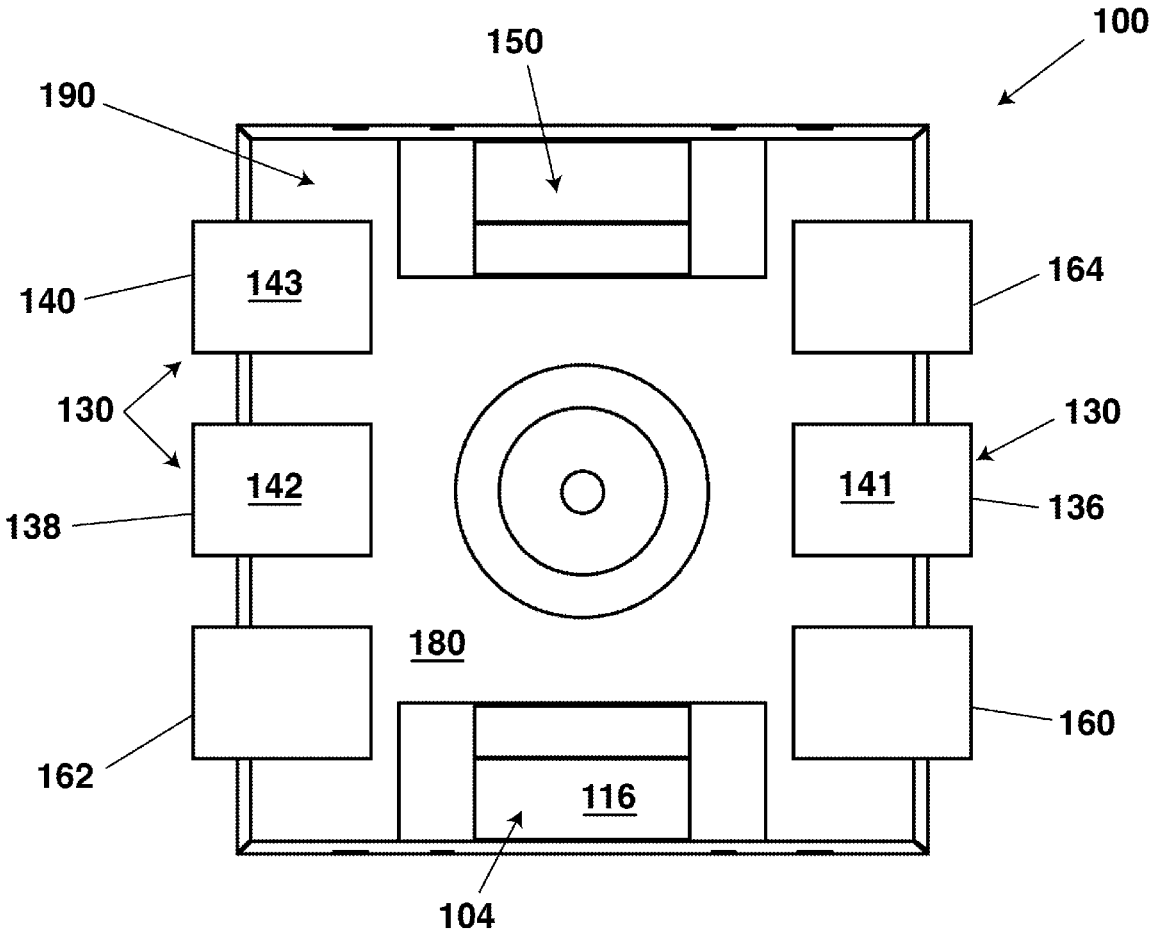
FIG. 2 is a bottom plan view of the light source of FIG. 1.

Each of the support members 136, 138, 140 may have a mounting portion attached thereto. The mounting portions serve to connect the light source 100 to a circuit board. In some embodiments, the mounting portions serve to connect the light source 100 to the circuit board by way of surface mount technology. The mounting portions are referred to individually as the first mounting portion 141, the second mounting portion 142, and the third mounting portion 143. The second mounting portion 142 is shown in FIG. 2, which is a bottom view of the light source 100.

In some embodiments, the light source 100 may have a third lead 150 located adjacent the first lead 104. The third lead 150 may be identical or substantially identical to the first lead 104. The use of three leads, 104, 130, 150 enables the light source 100 to use three different LEDs or three different pluralities of LEDs. Each lead may contain a different color of LED or LEDs, which enables the light source 100 to emit a broad spectrum of light colors. More specifically, the intensity of light emitted by the LEDs associated with a specific lead may be varied in order to produce a desired color of light.

The light source 100 may also include a plurality of secondary leads. The secondary leads are referred to individually as the first secondary lead 160, the second secondary lead 162, and the third secondary lead 164. The secondary leads 160, 162, 164 provide complete electrical circuits for the light emitters mounted to the leads 104, 130, 150. Wires connect the light emitters to their respective secondary connectors. A first wire 165 connects the first light emitter 110 to the first secondary lead 160. A second wire 166 connects the second light emitter 134 to the second secondary lead 162. A third wire 167 connects the light emitter on the third lead 150 to the third secondary lead 164.

For orientation purposes, the light source 100 is described as having a first end 170 and an opposite second end 172. Between the ends 170, 172 is a first edge 174 and a second edge 176 located opposite the first edge 174. Light is emitted from a first side 178 and an opposite second side 180 connects the light source 100 to a circuit board or the like.

As shown in FIG. 1, the mounting portions on the second lead 130 and the mounting portions on the secondary leads 160, 162, 162 fold inward. This folding of the mounting portions along with the other surfaces of the leads creates a cavity. A material 190, FIG. 2, may be located in the cavity. The material 190 may be an electrical insulator and may serve to maintain the leads in a fixed position. In some embodiments, the material 190 is less conductive than the first lead 104. With regard to the first side 178, the light emitters are mounted there and the design has a substantial amount of lead material on the first side 178, including the tabs 120, 122. Therefore, heat is readily removed via the lead material.

Most conventional light sources using multiple light emitters have leads that extend along the sides, which would correspond to the edges 176, 178 of the light source 100. The leads on many conventional light sources do not extend along the ends, which corresponds to the ends 170, 172 of the light source 100. The light source 100 described herein has leads extending around the circumference, which provides more paths for heat to dissipate from the light emitters. Therefore, the light source 100 is able to operate at greater intensity and is able to generate more heat.

During fabrication of the light source 100 the first lead 104 and the third lead 150 may be stamped from a single sheet of metal. The first tab 120 and the second tab 122 maybe connected to the metal sheet. This connection holds the first lead 104 in place during fabrication. The first lead 104 is cut from the metal sheet at the tabs 120, 122. Rather than remove the tabs 120, 122, they are kept attached to the first lead 104 to act as heat sinks.

Figure 3:
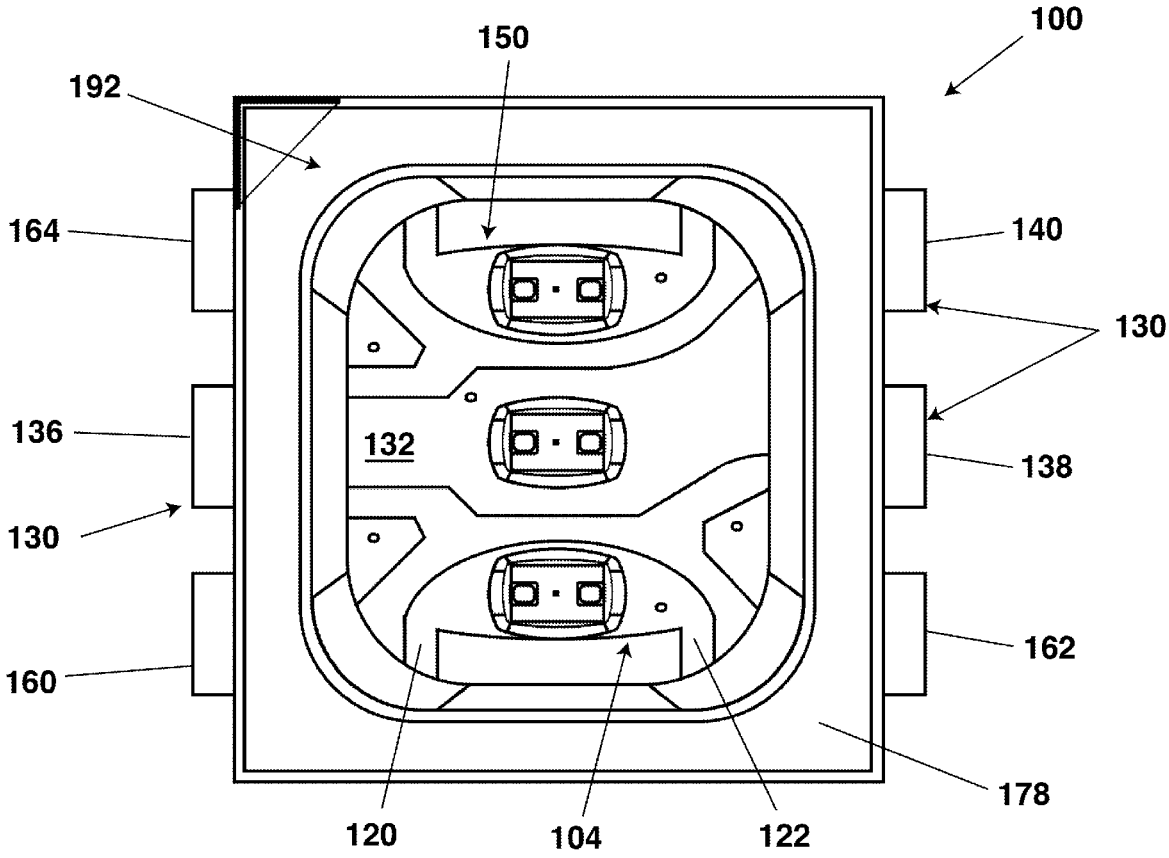
FIG. 3 is a top plan view of the completed light source of FIG. 1.

Referring to FIG. 3, which is a top plan view of an embodiment of the light source 100, a lens 192 or the like may cover the light emitters. The lens 192 may include a case that substantially encases the leads of the light emitter 100.

It is noted that other embodiments of the light source 100 may be fabricated. For example, the lead 130 may have a single support member in place of the individual support members 138 and 140. Such a configuration may enable more heat to be dissipated from the second light emitter 134. In such an embodiment, the lead 130 may have the to mounting portions 140, 142 in order to use surface mount technology to mount the light source 100 to a circuit board.

What is claimed is:

1. A light source comprising:

a first lead comprising a first mounting surface wherein a first light emitter is connectable to said first mounting surface, a support member attached to said first mounting surface, a conductor portion attached to said support member, and at least one tab extending from said first mounting surface, said at least one tab being used to hold said first lead during fabrication; and a second lead located adjacent said first lead, said second lead comprising a second mounting surface wherein a second light emitter is connectable to said second mounting surface, at least two support members attached to said second mounting surface, and a conductor portion attached to each of said support members.

2. The light source of claim 1 wherein said conductor portions are configured to mount to a circuit board using surface mount technology.

3. The light source of claim 1, wherein said light source comprises:

a first side, wherein light is emittable from said first side;

a second side located opposite said first side;

a first end extending between said first side and said second side;

a second end extending between said first side and said second side and located opposite said first end;

a first edge extending between said first end, said second end, said first side, and said second side; and a second edge extending between said first end, said second end, said first side, and said second side and located opposite said first edge;

wherein said support member of said first lead extends along said first edge; and wherein at least one support member of said second lead extends along said second edge.

4. The light source of claim 3, wherein at least two support members of said second lead extend along said second edge.

5. The light source of claim 1, wherein the boundaries of said first lead and said second lead form a cavity and wherein a material is located in said cavity.

6. The light source of claim 5, wherein said material is less electrically conductive than said first lead.

7. The light source of claim 1 and further comprising a third lead, said third lead being substantially similar to said first lead and being located adjacent the first lead.

8. The light source of claim 7, wherein said third lead is located proximate a second end extending between a first side and a second side, the second end being located opposite a first end, wherein light is emittable from the first side, wherein the second side is located opposite the first side, and wherein the first end extends between the first side and the second side.

9. The light source of claim 7, wherein said third lead is located adjacent said second lead and on an opposite side of said second lead relative to said first lead.

10. The light source of claim 1, wherein said at least one tab extends toward the periphery of said light source.

11. The light source of claim 1 and further comprising at least one fourth lead, said at least one fourth lead comprising:

a mounting surface adapted to have a wire attached thereto;

a support member extending from said mounting surface, said support member being substantially perpendicular to said mounting surface; and a mounting portion extending from said support member; wherein said support member extends along said first side.

12. The light source of claim 11, wherein said wire extends between said first light source and said mounting surface of said fourth lead.

13. A light source comprising:

a first side, wherein light is emittable from said first side a second side located opposite the first side;

a first end extending between said first side and said second side;

a second end extending between said first side and said second side, said second end being located opposite said first end;

a first edge extending between said first side and said second side, said first edge being located proximate said first end and said second end;

a second edge extending between said first side and said second side and located opposite said first edge, said second edge being located proximate said first end and said second end;

a first lead comprising a mounting surface located proximate said first side, wherein a light emitter is connectable to said mounting surface, a support member attached to said mounting surface and located proximate said first end, a conductor portion attached to said support member and located proximate said second side; and a second lead a mounting surface located proximate said first side wherein a second light emitter is connectable to said mounting surface, at least one first support member attached to said mounting surface and located proximate said first edge, a first conductor portion attached to said at least one first support member and located proximate said second side, at least one second support member attached to said mounting surface and located proximate said second edge, and a mounting portion attached to said at least one second support member and located proximate said second side.

14. The light source of claim 13 and further comprising a third lead comprising a mounting surface located proximate said first side, wherein a light emitter is connectable to said mounting surface, a support member attached to said mounting surface and located proximate said second end, a conductor portion attached to said support member and located proximate said second side.

15. The light source of claim 14, wherein said third lead comprises at least one tab extending from said mounting surface, said at least one tab used to hold said third lead during fabrication.

16. The light source of claim 13, wherein said first lead comprises at least one tab extending from said mounting surface, said at least one tab used to hold said first lead during fabrication.

17. The light source of claim 13 and further comprising at least one fourth lead, said at least one fourth lead comprising:

a mounting surface adapted to have a wire attached thereto;

a support member extending from said mounting surface, said support member being substantially perpendicular to said mounting surface and located proximate said first edge; and a mounting portion extending from said support member and located proximate said second side.

18. The light source of claim 17 and further comprising a light emitter connected to said mounting surface of said first lead.

19. The light source of claim 18 and further comprising a wire extending between said mounting surface of said fourth lead and said light emitter.

20. The light source of claim 13, wherein said first lead, said second lead, and said third lead form a cavity and wherein a material is located within said cavity, said material being less conductive than said first lead.

* * * * *